US006761226B2

(12) United States Patent
Carrier et al.

(10) Patent No.: US 6,761,226 B2
(45) Date of Patent: Jul. 13, 2004

(54) FIRE FIGHTING APPARATUS

(75) Inventors: Brian E Carrier, Eldred, PA (US); Bonnie Carrier, Goose Creek, SC (US); Pamela Baughman, Lewis Run, PA (US)

(73) Assignee: Carba Fire Technologies, Inc., Lewis Run, PA (US)

( * ) Notice: Subject to any disclaimer, the term of this patent is extended or adjusted under 35 U.S.C. 154(b) by 0 days.

(21) Appl. No.: 10/328,439

(22) Filed: Dec. 23, 2002

(65) Prior Publication Data

US 2003/0089507 A1 May 15, 2003

Related U.S. Application Data

(63) Continuation of application No. 09/824,270, filed on Apr. 2, 2001, now abandoned, which is a continuation-in-part of application No. 09/575,041, filed on May 19, 2000, now abandoned.

(51) Int. Cl.[7] ..... A62C 27/00

(52) U.S. Cl. ..... 169/24; 169/25; 169/13; 239/172

(58) Field of Search ..... 169/24, 25, 13, 169/14, 18, 52, 67, 68, 70; 239/146, 172, 754

(56) References Cited

U.S. PATENT DOCUMENTS

| | | | | | |
|---|---|---|---|---|---|
| 3,433,417 | A | * | 3/1969 | Poppitz | 239/142 |
| 4,037,664 | A | * | 7/1977 | Gibson | 169/24 |
| 5,467,827 | A | * | 11/1995 | McLoughlin | 169/24 |
| 5,476,146 | A | * | 12/1995 | Brown | 169/24 |
| 6,029,750 | A | * | 2/2000 | Carrier | 169/52 |
| 6,092,911 | A | * | 7/2000 | Baker et al. | 169/24 |

* cited by examiner

*Primary Examiner*—Robin O. Evans
(74) *Attorney, Agent, or Firm*—Edward W. Goebel, Jr.; Jon L. Woodard; MacDonald Illig Jones & Britton LLP

(57) ABSTRACT

A fire fighting apparatus comprising a container with two tanks therein, one holding a quantity of water and another holding a quantity of foaming agent, a pump operated by a gasoline engine, several hoses for directing a water/foam mixture at a fire and for refilling the water tank with water from a source, and a valve system for directing the water/foam mixture through two different hoses at the fire while water from a source is used either directly on the fire or for replacing water taken from the tank. The apparatus is held within a container mounted on casters so that it can be conveniently wheeled about. The unit is adapted for use in areas remote from fire departments.

29 Claims, 5 Drawing Sheets

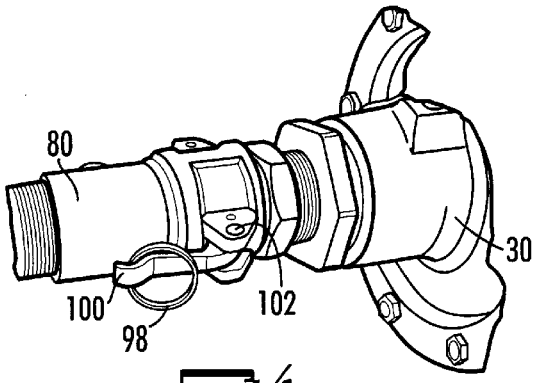
FIG. 4
FIG. 5
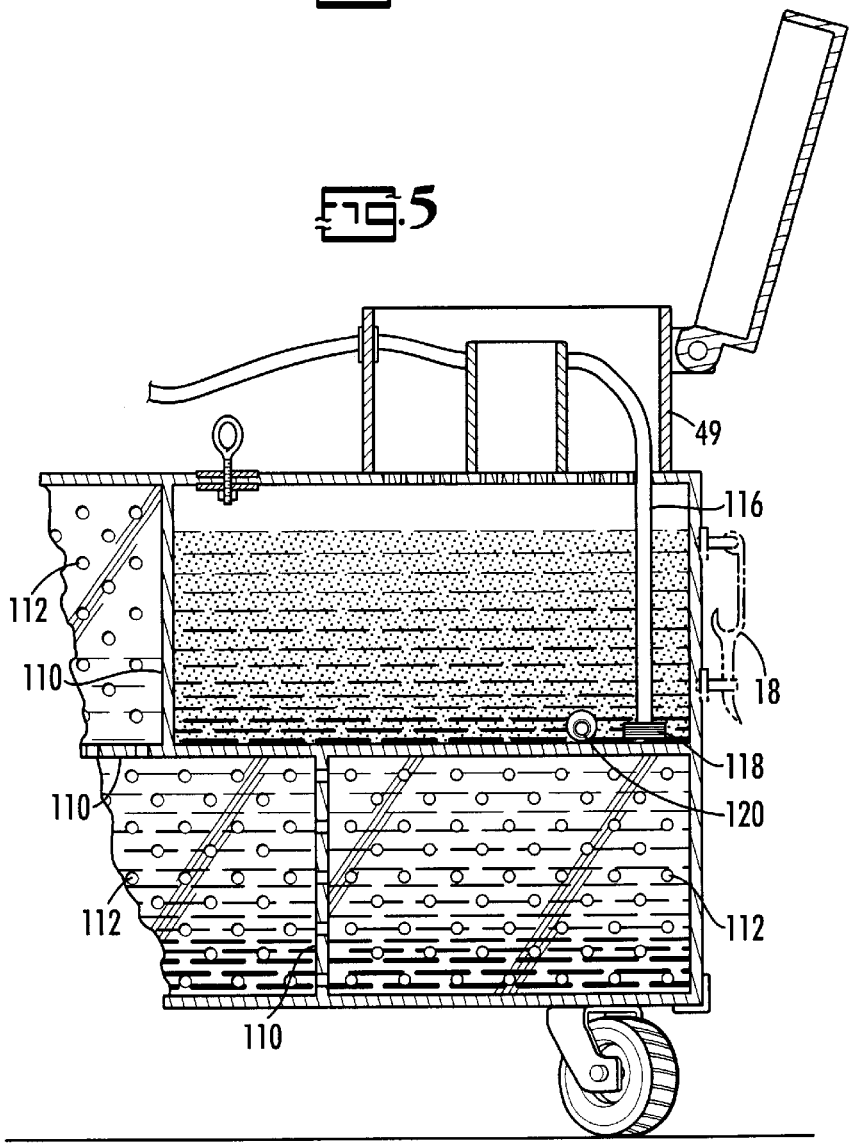

FIRE FIGHTING APPARATUS

CROSS-REFERENCE TO RELATED APPLICATIONS

This application is a continuation of prior U.S. application Ser. No. 09/824,270 filed on Apr. 2, 2001 now abandoned, of the same title. U.S. application Ser. No. 09/824,270 is a continuation-in-part of application Ser. No. 09/575,041 filed on May 19, 2000, now abandoned. The entire contents of these two prior applications are expressly incorporated herein by reference.

STATEMENT REGARDING FEDERALLY SPONSORED RESEARCH OR DEVELOPMENT

Not applicable.

REFERENCE TO A MICROFICHE APPENDIX

Not applicable

FIELD OF INVENTION

The present invention relates to fire fighting apparatus.

BACKGROUND OF THE INVENTION

A long time ago, fire fighting was left up to the property owner. In towns and other communities where homeowners lived in a neighborhood—and where there was a greater risk of fires spreading to neighboring homes—neighbors would pitch in to help put out a fire. When a home caught fire, neighbors would form bucket brigades, lines of people that passed a series of buckets—from a water source to a fire. Eventually, private fire fighting organizations developed that would put out fires for a fee using private pumping equipment. The home owner would have to negotiate the price for putting out his fire while the fire raged. This approach gave way to volunteer fire companies and municipal fire departments that are responsible for putting out fires whenever they occur in the community they serve and look to that community as a whole for financial support.

Nonetheless, not all homes, businesses, factories and properties are equally served by fire departments. In particular, rural homes and farms may be miles from fire departments. Municipal water supplies may not serve homeowners in remote areas. Consequently, as a practical matter for those who live in the country, fire fighting is left up to the property owner.

In some cases, those living in rural areas intentionally start fires, for example, in clearing land. It is foreseeable that these fires might get out of control. Although it will always be clear that a fire has gotten out of control, it is not always so clear that a fire will get out of control in advance. Furthermore, the shift from a controlled burn to an out of control fire may happen quickly. By the time fire fighting help arrives, containment may be much more difficult because of the fire's momentum. Prudent foresight dictates that those conducting a controlled burn be prepared in case the fire starts getting out of control.

Self-help in putting out fires is addressed by use of simple fire extinguishers which are small tanks that carry fire suppressant under pressure. These tanks are intended to be relatively light weight so that they can be quickly carried to the scene of a fire. For small fires such as kitchen fires and some automotive fires, they work well. For larger fires, they are simply inadequate.

There is thus a need for a way for private homes not adequately served by volunteer fire companies and municipal fire departments to cope with fires.

SUMMARY OF THE INVENTION

According to its major aspects and briefly recited, the present invention is a fire fighting apparatus for private use. It is relatively mobile so that a user can wheel it into position in the event of a fire and bring its fire-fighting capabilities to bear on a fire. However, it can alternatively be installed in a plant for industrial use or in the home for home use, if desired. The apparatus includes a first tank for holding a quantity of water and a second tank for holding a suitable quantity of a foaming agent within the same container, a pump connected to the tank, a gasoline engine for driving the pump, hoses and valves for directing the fire suppressing foamed water at a fire and drawing additional water from a local source, and a hose and valve system.

A feature of the present fire fighting unit is the juxtaposition of the first tank with the water and a second tank with foaming agent in a small mobile unit. The two tanks cooperate to provide much more fire suppressant than would be possible in a fire extinguisher but is smaller than a fire engine. Thus, the present fire fighting unit is useful in a greater variety of situations where a fire must be extinguished than would be a conventional fire extinguisher and yet more practical than a fire engine in many others.

Another feature of the present invention is the combination of a pump and small gasoline engine. While conventional fire extinguishers rely on internal pressure to deliver fire suppressant, the present invention uses a pump powered by a gasoline engine to deliver pressure and volume of water at a greater power level over a longer period of time. This capability enables the user to remain at a greater distance from a fire for a longer time while still delivering the fire suppressing foam.

Yet another feature of the present invention is the capability by suitable use of its hose and valving system to replenish the water used from the first tank while still fighting the fire. Regardless of the size of the first tank, for some fires, the water in the first tank will be exhausted before the fire is out unless the water is replenished. By enabling the first tank to be replenished by the pump while the pump continues to deliver water to the fire, the unit provides uninterrupted fire fighting capability until the last embers are out.

An advantage of the present invention is that it can be put into position as part of the preparations for starting an intentional fire. In the event the fire seems to be getting out of hand, the unit can be started in an attempt to contain it without having to summon a fire department or to limit damage caused by the initial stages of the fire while waiting for assistance. Timely action with the present apparatus may obviate the need for such a summons and prevent injuries or limit damage to property while a fire department is responding.

The present invention can also be used to fight fires on the interior of a residence or business, including, for example a warehouse or storage building, which is a particular advantage of the present invention.

Still another advantage of the present invention is the use of simplified structure and quickly disconnectable hoses and conduits so that the device can be set up and taken down quickly and completely, to be used separately from the tank, such as, for example, in the case of a flooding basement.

The use of internal baffle plates to minimize the sloshing of water in the tank is also an important feature of the present invention. These plates make it easier to haul and position the present apparatus when it is full or nearly full of water or when used for transporting or carrying other liquids such as gels, gasoline, diesel fuel, or other products in a liquid state.

Finally, the present unit has commercial applications in addition to private ones. These units can be carried in the bed of pickup trucks and delivered quickly for use in fighting brush fires and other smaller fires. It can be used in industrial settings where fires can start easily or spread quickly, especially those where fire engines might not be able to maneuver easily, such as parking garages and warehouses.

Other features and advantages will become apparent to those skilled in fire fighting from a careful reading of the Detailed Description of Preferred Embodiment accompanied by the following drawings.

BRIEF DESCRIPTION OF THE DRAWINGS

In the drawings,

FIG. 4 illustrates a "quick release" connection as is preferred for use with the present invention;

FIG. 5 is a partial, cross sectional view of an apparatus according to a preferred embodiment of the present invention.

DETAILED DESCRIPTION OF PREFERRED EMBODIMENTS

Figure 1:
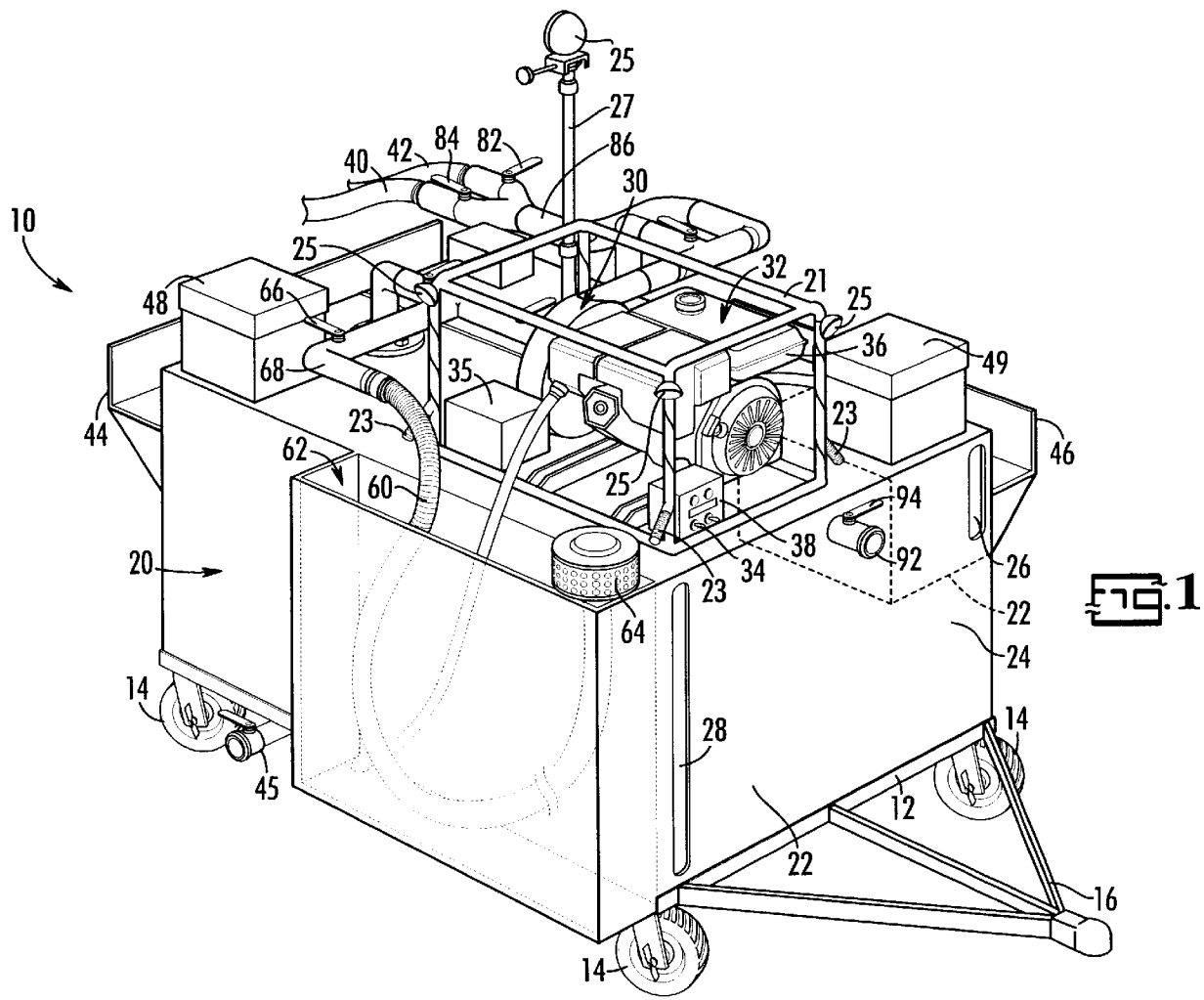
FIG. 1 is a front, perspective view of a fire fighting unit according to a preferred embodiment of the present invention.
Figure 2:
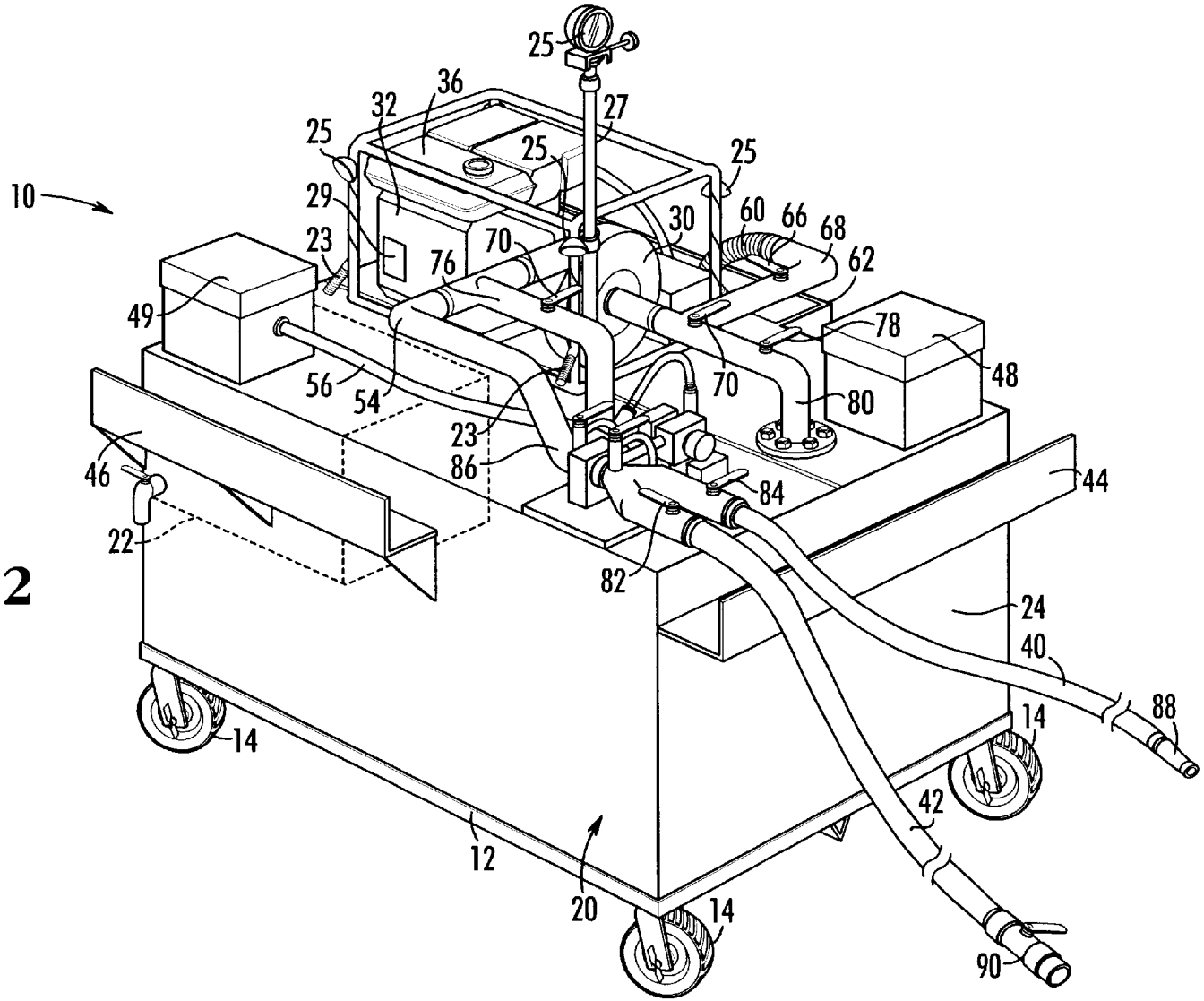
FIG. 2 is a rear perspective view of the fire fighting unit of FIG. 1.
Figure 3:
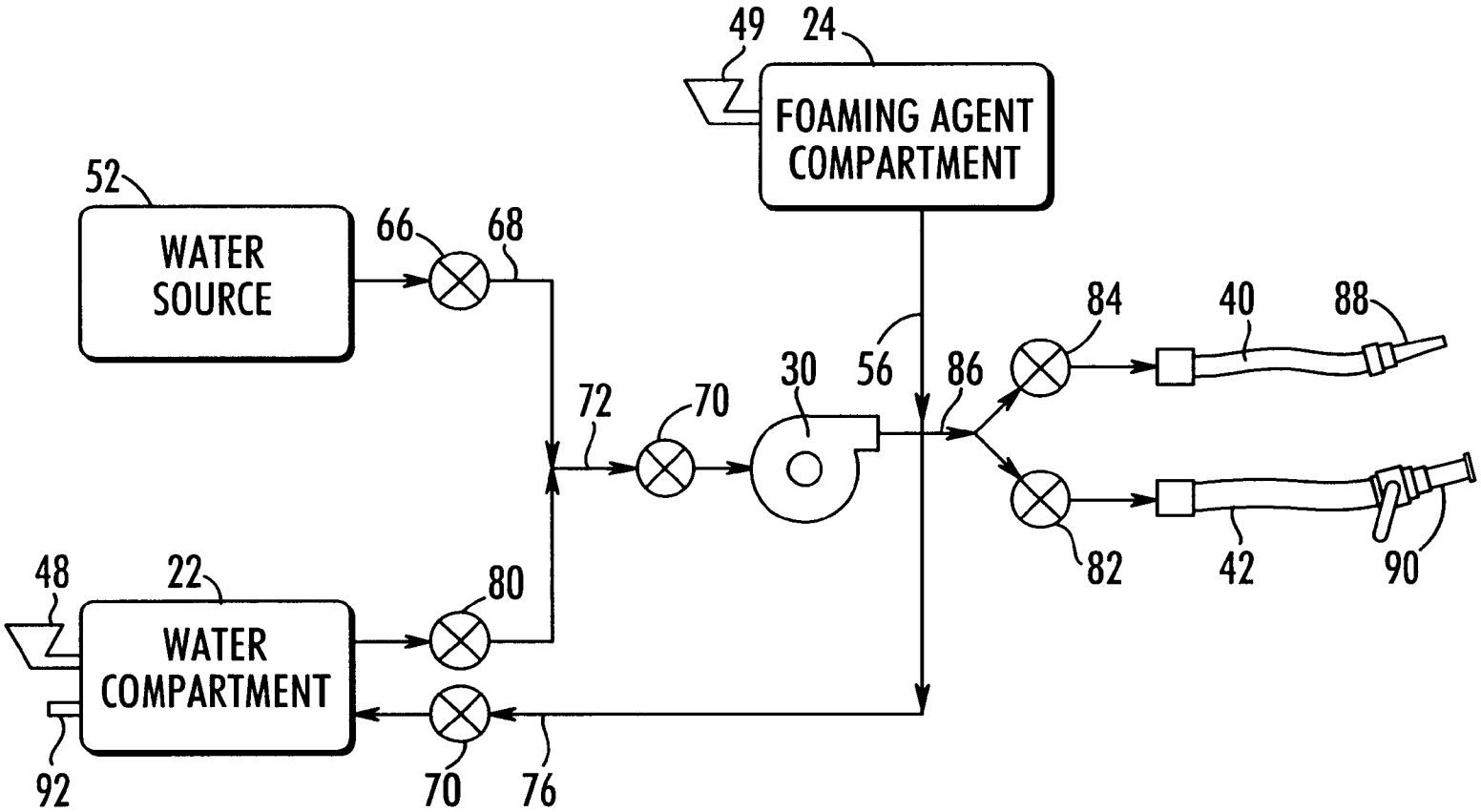
FIG. 3 is a schematic view of the fire fighting unit, according to a preferred embodiment of the present invention.

The present invention is an apparatus for fighting fires. It is intended for use with fires that are or could become larger than those that would require a fire extinguisher and smaller that those that would require a fire engine. It is ideally suited for use in a rural environment to begin to bring a fire under control or at least attempt to slow it until assistance arrives.

Alternatively, the present apparatus can be used to augment larger scale fire fighting equipment simply because it can be taken to places that are more difficult for fire engines to reach, set up and put to work fighting a fire, such as in parking garages, warehouses, brush fires and wildfires. In the instance a fire engine cannot get close enough to the fire but has a long enough hose, the fire engine can hook up to the present apparatus and directly supply water to the tank and pump.

Referring now to the figures, the present fire-fighting apparatus, generally indicated by the reference number 10, includes a frame 12 with four wheels 14 attached thereto. Preferably, wheels 14 are castors but may be larger. The term "castors" is used in its customary sense and refers to wheels that are attached to a vertical shaft and mounted to frame 12 in such a way that frame 12 can be pulled in any direction and the shaft will allow wheels 14 to rotate so as to permit apparatus 10 to roll in the direction pulled. A hitch 16 attached to frame 12 can be used to pull apparatus 10.

As an alternative to the embodiment shown, apparatus 10 can be set up to operate in a wheel barrow fashion with one or two wheels on one end and a support on an opposing end, or to have two axles and four all-terrain tires for moving through tall grass and fields. As long as apparatus is stable and can be wheeled into position, it can serve the function for which it is intended.

Frame 12 is dimensioned to hold fire-fighting equipment. On frame 12 is a container 20 having two tanks, a first tank 22 for water and an adjacent second tank 24 for a foaming agent. Tanks 22 and 24 are preferably equipped with sight fill levels 26, 28, respectively, so that the user can determine at sight by the level of the fluid in first tank 22 or second tank 24 how full it is. The availability of a foaming agent is very important for extending the water supply and allowing a larger fire to be suppressed than could be done with water alone. The use of foaming agents and types of foaming agents available as fire suppressants are well known to those skilled in fire-fighting equipment. Container 20 is preferably sized for first tank 22 to hold 100–500 gallons of water and second tank 24 to hold three to 50 gallons of foaming agent which range corresponds to the range in the volume of water in first tank 22. However, the size of tanks can be increased for the particular purpose and environment of use. Also, for convenience, a spanner wrench 18 (FIG. 5) may be carried on container 20 to tighten or loosen hoses, pry bars, or to turn on city water valves.

The interior of first tank 22 is fitted with baffle plates 110 having a multiplicity of holes 112 formed therein. Baffle plates 110 are arranged at right angles to the walls of first tank 22 and to each other and prevent water from sloshing when apparatus 10 is moved but otherwise water may flow throughout first tank 22 easily.

First and second tanks 22, 24 have a suction hose 116 in each with a check ball "foot" valve in a cannister 118 at the end thereof, positioned about one inch from the bottom of first and second tanks 22, 24 (only the cannister 118 in second tank 24 shown). Preferably the valve cannister 118 can be unthreaded to replace valve parts and clean the valve. This type of valve keeps pump 30 primed after the initial startup. Second tank 24 has its own drain 120.

Connected to container 20 is a pump 30 driven by a gasoline or diesel engine 32. Engine 32 is selected to have sufficient horsepower to operate pump 30 and to be quickly started, preferably with an ignition switch 34 connected to a small battery 35, but alternatively with a pull cord. An engine such as that manufactured by HONDA, L1.0 with a pull start and an electronic ignition GX340 is suitable. A fuel tank 36 supplies gasoline to engine 32. Engine 32 preferably drives pump 30 directly as shown but may alternatively be driven by a belt or chain drive and pulley system. A control panel 38 houses switch 34 for engine 32.

Pump 30 is sized to produce the same flow volumes and the same pressures as that delivered by a fire truck, namely, 150–250 gallons per minute at 150 psi. Obviously, pump 30 can be selected to deliver the flow volumes and pressures that best suit the particular application.

Pump 30, engine 32, control panel 38, battery 35, and fuel tank 36 are carried within a frame 21 having four lifting handles 23 that facilitate removal of these components and frame 21 itself from container 20 when necessary. Frame 21 also has lights 25 attached to it for use at night or in dim light. Lights 25 are driven off battery 35 either directly or via an inverter 29 to produce 115 volts AC from 12 volts DC, and are preferably the type that can be directed as desired simply be turning them in the appropriate direction. Inverter 29 also acts as a source of household current for other needs. One light 25 is attached to a mast 27; the remaining lights 25 are carried directly on frame 21.

Figure 6:
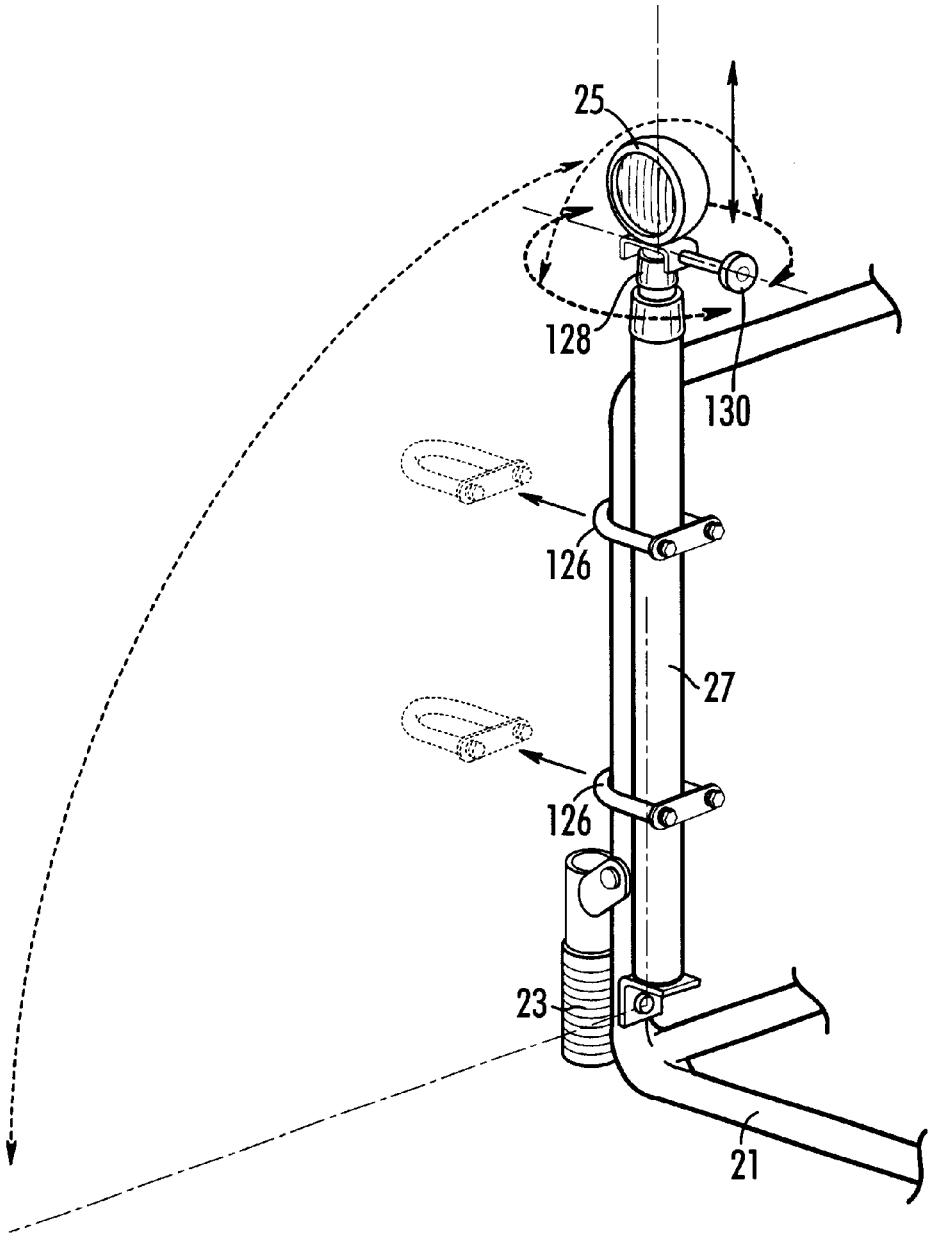
FIG. 6 is a detail drawing of the light mast, according to a preferred embodiment of the present invention.

As illustrated in FIG. 6, light mast 27 is preferably attached to frame 21 so that mast 27 rotates about its vertical axis and, upon loosening several U-bolts 126, may also be rotated down toward container 20. Preferably also mast 27 is telescoping and can be rotated about an axis through its base 128 by rotating a small control knob 130. With four degrees of freedom, three rotational and one translational, light 25 on mast 27 can be directed as the user wishes.

One but preferably two hoses 40, 42, can be connected to pump 30. First hose 40 is preferably a smaller diameter hose, preferably a one inch hose. Second hose 42 is preferably a larger hose, preferably a 1½ inch hose. Second hose 42 will use up the water supply in container 20 more quickly than first hose 40 but provides greater fire-suppressing power. As will be explained, both hoses can be used at the same time. Hoses 40, 42 are stored in trays 44, 46, on one side of container 20. Each hose 40, 42, may be a series of hoses connected together to form longer hoses. The ultimate length will depend on the pump size.

Container 20 also requires a drain valve 45 for when first tank 22 needs to be purged and cleaned.

Apparatus 10 also has a first fill tower 48 that permits first tank 22 to be filled with water from, for example, a garden hose and a second fill tower 49 that permits second tank 24 to be filled with additional foaming agent.

Alternatively, a suction hose 60, carried in a bin 62 on container 20, is used to draw water from a lake, pond, swimming pool or other source 52 of water. Suction hose 60 has a filter 64 on its end and is reinforced to prevent its collapsing. A valve 66 on a conduit 68 to which suction hose 60 is connected, when opened, allows pump 30 to draw water through suction hose 60 into the inlet side of pump 30 provided that a valve 70 in conduit 72 is also opened. Another valve 74 in conduit 76, when opened, allows water drawn through suction hose 60 by pump 30 to be used to refill second tank 24. Alternatively to an external source, a valve 78 in conduit 80, when opened, allows water to be drawn from first tank 24 into the inlet side of said pump 30. Opening valves 70 and 78 will allow water to be drawn from both sources simultaneously.

When water is needed for fighting fires, either or both valves 82 and 84 in conduit 86 can be opened, which enables pump 30 to deliver water to hoses 40 and 42 from its outlet side. Hose 40 has a conventional nozzle valve 88 that opens by rotating it about an axis parallel to the direction of hose 40. Second hose 42 has a valve 90 that opens by rotating a lever about an axis perpendicular to hose 42.

First tank 24 may also be filled by another hose at connection 92 if valve 94 is opened.

All connections to valves 66, 70, 74, 78, 82, and 84 and pump 30 are so-called "quick-release" type. A typical quick-release connection 96 is illustrated in FIG. 4; this connection 96, illustrated as connecting conduit 80 to pump 32, has a ring 98 on a lever 100. Pulling on lever 100 or ring 98, rotates lever 100 between a locked position (as shown) and an unlocked position about pivot pin 102. Lever 100, which has a cam surface, releases its connection as lever 100 rotates. In literally seconds, all connections can be released and hoses and conduits can be disconnected or reconnected. Similarly, frame 21, preferably secured to compartment 20 with four bolts, can be removed along with pump 30, engine 32, ignition switch 34, battery, 35, fuel tank 36 and control panel 38 by removing the four bolts and lifting frame 21 with lifting handles 23.

The present apparatus 10 also includes a foam proportioner 140 that controls the thickness of the foam and creates suction needed to draw the foaming agent from tank 24. Foam proportioner 140 is connected using quick release connections so that it can be removed with pump 30 when separated from the tank In use, engine 32 is started with ignition switch 34 on control panel 38 to start pump 30. Valves 70, 78 and either 82 or 84, or both, are opened to allow pump 30 to draw water from first tank 22 and pump it to hoses 42 or 40, respectively. By then opening nozzle 88 or valve 90, water may be directed on a fire or used to wet down surfaces to prevent them from succumbing to the fire. If the size of the fire is large enough, hose 60 can be run to another source 52 of water, and then valves 66 and 70 can be opened to allow water to be drawn from source 52 and used not only to fight the fire but also to refill first tank 22. If additional water is needed or there is no source 52, water can be added either through fill tower 48 or through connection 92.

It will be apparent to those skilled in the art of fire fighting apparatus that many changes and substitutions can be made to the foregoing preferred embodiments without departing from the spirit and scope of the present invention, defined by the appended claims.

What is claimed is:

1. A fire fighting apparatus, comprising:

a main frame;

plural castors attached to and arranged to support said main frame;

a pump carried by said main frame, said pump having an inlet side and an outlet side and sized to have the capability of delivering liquid at a flow volume and pressure suitable for fighting fires;

an engine for driving said pump and having an operational connection with said pump;

a first tank carried by said main frame for holding a quantity of water, said first tank connected to said inlet side of said pump and in fluid communication therewith large enough so that said pump can pump water from said tank;

at least one fire hose connectable to said outlet side of said pump said fire hose having a size which is large enough for conveying a volume of water from said pump which is suitable for fighting fires; and, a suction hose connectable to said inlet side of said pump, said suction hose having a size large enough to enable said pump to volume of a volume of water suitable for fighting fires from a source of water other than said tank.

2. The first fighting apparatus as recited in claim 1, further comprising a second tank for holding a foaming agent.

3. The fire fighting apparatus as recited in claim 1, wherein said at least one fire hose comprises a one inch hose and a one and one-half inch hose.

4. The fire fighting apparatus as recited in claim 2, wherein said engine is a gasoline engine.

5. The fire fighting apparatus as recited in claim 1, wherein said at least one fire hose comprise two fire hoses.

6. The fire fighting apparatus as recited in claim 5, wherein said two fire hoses include a one-inch fire hose.

7. The fire fighting apparatus as recited in claim 5, wherein said two fire hoses include a one and one-half inch fire hose.

8. The fire fighting apparatus as recited in claim 2, further comprising a lighting system carried by said frame for providing lighting in an area occupied by said apparatus.

9. The fire fighting apparatus as recited in claim 2, wherein said engine is a gasoline engine with an ignition switch.

10. The fire fighting apparatus as recited in claim 2, further comprising a plurality of valves for directing said water and foaming agent through said at least one hose, when said at least one fire hose is connected to said outlet side of said pump.

11. The fire fighting apparatus as recited in claim 1, wherein said suction hose and said at least one hose are connected to said pump using quick-disconnect couplings.

12. A fire fighting apparatus, comprising:

a main frame;

a plurality of wheels attached to and arranged to support said main frame;

a pump carried on said main frame, said pump having an inlet side and an outlet side and sized to have the capability of delivering liquid at a flow volume and pressure suitable for fighting fires;

an engine for driving said pump, said engine being in operational connection with said pump;

a second frame carried by said main frame and removable therefrom, said pump and said engine being attached to said second frame and removable therewith from said main frame;

a first tank carried by said main frame for holding a quantity of water;

a second tank carried by said main frame for holding a quantity of a foaming agent, said first and said second tanks being in fluid communication with said pump so that said pump can pump a flow of fluid either from said first tank or from both said first and said second tanks, and at least one outlet fire hose connectable to said outlet side of said pump, said at least one fire hose having a size which is large enough for discharging said flow of fluid which is suitable for fighting fires when said fire hose is connected to said outlet side of said pump.

13. The fire fighting apparatus as recited in claim 12, further comprising:

a lighting system carried by said frame for providing lighting in an area occupied by said apparatus; and a battery for powering said lighting system.

14. The fire fighting apparatus as recited in claim 12, further comprising valve means for directing said flow, and wherein said valve means is adapted to direct water from a water source through a suction hose in fluid communication with said inlet side of said pump and bypassing said first and second tanks.

15. The fire fighting apparatus as recited in claim 12, wherein said at least one fire hose means comprises two outlet hoses.

16. The fire fighting apparatus as recited in claim 15, wherein said two fire hoses are connected to said pump through quick disconnect couplings.

17. The fire fighting apparatus as recited in claim 15, wherein said two fire hoses include a one-inch hose and a one and one-half inch hose.

18. A fire fighting apparatus, comprising:

a main frame;

plural castors attached to and arranged to support said main frame;

a pump carried by said main frame, said pump having an inlet side and an outlet side and sized to have the capability of delivering liquid at a flow volume and pressure suitable for fighting fires;

an engine for driving said pump and having an operational connection with said pump;

a second frame carried by said main frame and removable therefrom, said pump and said engine being attached to said second frame and removable therewith from said main frame;

a first tank carried by said main frame for holding a quantity of water, said first tank connected to said inlet side of said pump and in fluid communication therewith large enough so that said pump can pump water from said tank;

at least one fire hose connectable to said outlet side of said pump said fire hose having a size which is large enough for conveying a volume of water from said pump which is suitable for fighting fires; and, a suction hose connectable to said inlet side of said pump, said suction hose having a size large enough to enable said pump to pump a volume of water suitable for fighting fires from a source of water other than said tank.

19. The fire fighting apparatus as recited in claim 18, wherein said at least one fire hose comprises a one inch hose and a one and one-half inch hose.

20. The fire fighting apparatus as recited in claim 18, wherein said suction hose and said at least one fire hose are connected to said pump using quick-disconnect couplings.

21. The fire fighting apparatus as recited in claim 18, further comprising a second tank for holding a foaming agent and a plurality of valves for directing said water and foaming agent through said at least one hose, when said at least one hose is connected to said outlet side of said pump.

22. The first fighting apparatus as recited in claim 18, further comprising a second tank for holding a foaming agent.

23. The fire fighting apparatus as recited in claim 18, wherein said engine is a gasoline engine.

24. The fire fighting apparatus as recited in claim 18, wherein said at least one fire hose comprise two fire hoses.

25. The fire fighting apparatus as recited in claim 18, wherein said at least one fire hose comprises two fire hoses and said two fire hoses include a one-inch fire hose.

26. The fire fighting apparatus as recited in claim 18, wherein said at least one fire hose comprises two fire hoses and said two fire hoses include a one and one-half inch hose.

27. The fire fighting apparatus as recited in claim 18, further comprising a second tank for holding a foaming agent and a lighting system carried by said frame for providing lighting in an area occupied by said apparatus.

28. The fire fighting apparatus as recited in claim 18, further comprising a second tank for holding a foaming agent and wherein said engine is a gasoline engine with an ignition switch.

29. A fire fighting apparatus, comprising:

a main frame;

plural castors attached to and arranged to support said main frame;

a pump carried by said main frame, said pump having an inlet side and an outlet side and sized to have the capability of delivering liquid at a flow volume and pressure suitable for fighting fires;

a gasoline engine for driving said pump and having an operational connection with said pump;

a second frame carried by said main frame and removable therefrom, said pump and said engine being attached to said second frame and removable therewith from said main frame;

a first tank carried by said main frame for holding a quantity of water, said first tank connected to said inlet side of said pump and in fluid communication therewith large enough so that said pump can pump water from said tank;

a second tank carried by said main frame for holding a framing agent, said second tank connected to said pump and in fluid communication therewith;

at least one fire hose connectable to said outlet side of said pump said fire hose having a size which is large enough for conveying a volume of water from said pump which is suitable for fighting fires;

a suction hose connectable to said inlet side of said pump, said suction hose having a size large enough to enable said pump to pump a volume of water suitable for fighting fires from a source of water other than said first tank; and quick disconnect couplings connecting said at least one fire hose and said suction hose to said pump.

* * * * *